US005242201A

United States Patent [19]

Beeman

[11] Patent Number: 5,242,201

[45] Date of Patent: Sep. 7, 1993

[54] FISHING TOOL

[76] Inventor: Robert S. Beeman, 1708 Ray Ave., Bossier City, La. 71112

[21] Appl. No.: 750,077

[22] Filed: Aug. 26, 1991

[51] Int. Cl.[5] ..... B63C 11/52

[52] U.S. Cl. ..... 294/86.17; 294/86.15

[58] Field of Search ..... 294/86.17, 86.15, 86.25, 294/86.19, 86.24, 86.3, 86.31, 86.33, 86.26, 86.27, 86.28, 86.29

[56] References Cited

U.S. PATENT DOCUMENTS

| | | | |
|---|---|---|---|
| 803,450 | 10/1905 | Stegner et al. . | |
| 808,378 | 12/1905 | Johnston . | |
| 1,457,139 | 5/1923 | Bell et al. . | |
| 1,580,352 | 4/1926 | Ventresca . | |
| 1,619,254 | 3/1927 | Hart . | |
| 1,621,947 | 3/1927 | Moore . | |
| 1,638,494 | 8/1927 | Lewis et al. . | |
| 1,712,898 | 5/1929 | Newkirk . | |
| 1,728,136 | 9/1929 | Power . | |
| 1,779,123 | 10/1930 | Gates . | |
| 1,794,652 | 3/1931 | Stone . | |
| 1,815,462 | 7/1931 | Denney . | |
| 1,823,340 | 9/1931 | Vance | 294/86.15 |
| 1,917,135 | 7/1933 | Littell . | |
| 2,141,987 | 12/1938 | Jones . | |
| 2,290,409 | 7/1942 | Cuthill . | |
| 2,732,901 | 1/1956 | Davis . | |
| 2,806,534 | 9/1957 | Potts . | |
| 3,199,906 | 8/1965 | Chenoweth | 294/86.15 |
| 3,262,501 | 7/1966 | Winger . | |
| 3,638,989 | 2/1972 | Sandquist . | |
| 4,273,372 | 6/1981 | Sheshtawy | 294/86.17 X |
| 4,443,130 | 4/1984 | Hall | 294/86.15 X |
| 4,616,721 | 10/1986 | Furse . | |

*Primary Examiner*—Russell D. Stormer
*Assistant Examiner*—Joseph D. Pape
*Attorney, Agent, or Firm*—Rosenblatt & Associates

[57] ABSTRACT

A spear and overshot are provided that use a plurality of collets. The collets are initially displaced by the fish until they are presented against a reduced diameter portion of the apparatus. At that point, the collets are inwardly attracted and the apparatus can be lowered into the fish or onto the fish. Further movement of the apparatus allows engagement of the fish onto the collets as the collets spring back to their original position with the fish trap above. Thereafter, should the fish need to be released, hydraulic pressure is applied within the apparatus shifting a body with respect to the collets allowing them again to be radially inwardly deflected for release of the fish.

18 Claims, 5 Drawing Sheets

FISHING TOOL

FIELD OF THE INVENTION

The field of this invention relates to tools usable for retrieval of objects from subterranean wells. The tool may engage the inside or the outside of generally tubular objects and is commonly referred to in the industry as a spear or an over-shot.

BACKGROUND OF THE INVENTION

When conducting well operations, situations arise where objects must be retrieved from the wellbore. This can occur when casing or tubing experiences a catastrophic failure and a portion of the casing or tubing string falls to the bottom of the wellbore. The segment that has fallen into the bottom of the wellbore needs to be removed so that further operations can continue. Alternatively, certain kinds of tools used in drilling or workover operations may become stuck in the wellbore and may require retrieval with a tool such as a spear or an overshot.

In the past, various mechanical designs have been employed for such tools primarily involving a series of mechanically actuated grippers or slips to grab the object to be retrieved, or "fish," so that it can be brought to the surface. Typically, these designs have involved shear pins that must bee sheared to allow release from the fish if necessary. These tools are not resettable once the shear pin has been broken. The use of shear pins further limits the operational use of such tools in limiting the maximum upward pull that can be exerted. Pulling operations with tools that are released via a shear pin have to be carefully done to avoid inadvertent releases. Additionally, use of such tools even without shearing the pin can, due to the cyclical stresses imposed on shear pins weaken them so that they may fail under pulling forces smaller than normally anticipated.

Various tools in the past have employed different mechanisms to set the slips. Some have done so mechanically while others have done so hydraulically. Typical of such tools are U.S. Pat. Nos. 808,378 (mechanically set); 803,450 (hydraulically set); 1,457,139 (hydraulically set); 1,728,136 (hydraulically set); 1,619,254 (hydraulically set); 1,580,352 (hydraulically set); 1,621,947 (hydraulically set); 1,638,494 (hydraulically set); 1,712,898 (hydraulically set); 1,779,123; 1,794,652; 1,815,462; 1,917,135; 2,141,987; 2,290,409; 2,806,534; 2,732,901; 3,638,989; and 3,262,501. Some of these tools employ hydraulic force to move a piston to in turn move a mechanical member which in turn sets the slips for gripping. Thereafter, some mechanical action is required to release the slips such as breaking a shear pin by pulling up on the tool with sufficient force.

Also of interest is European Patent Application 0213798 which discloses a packer retrieval assembly. This device presents two different outside diameters so that it can be inserted through a packer and expanded to its larger diameter for retrieving the packer. This apparatus also uses shear pins to actuate from one position to another. U.S. Pat. No. 4,616,721 shows a packer retrieving tool having a milling feature for cutting loose the slips. This tool can disengage the packer only by failure of a ring component from hoop tension. At that point, the packer falls to its original position and the tool must be removed from the well to be reset.

Also of interest to the field of this invention is a packer retrieving tool product no. 646-17 made by Baker Oil Tools and referred to as Baker 43 RETRIEVA-D LOK-SET® which is used to retrieve Baker 43 RETRIEVA-D LOK-SET® packers.

The features not found in the prior art which have brought about the development of the apparatus of the present invention are primarily oriented toward a design which readily permits transmission of torque without mechanical damage and an apparatus that can be reset a multiplicity of times due to its dependency on an hydraulic release.

SUMMARY OF THE INVENTION

A spear and overshot are provided that use a plurality of collets. The collets are initially displaced by the fish until they are presented against a reduced diameter portion of the apparatus. At that point, the collets are deflected and the apparatus can be lowered into the fish or onto the fish. Further movement of the apparatus allows engagement of the fish onto the collets as the collets are forced back to their original position with the fish trapped above. Thereafter, should the fish need to be released, hydraulic pressure is applied within the apparatus, shifting the collets with respect to the body, allowing them again to be radially deflected for release of the fish.

DETAILED DESCRIPTION OF THE PREFERRED EMBODIMENT

Figure 1:
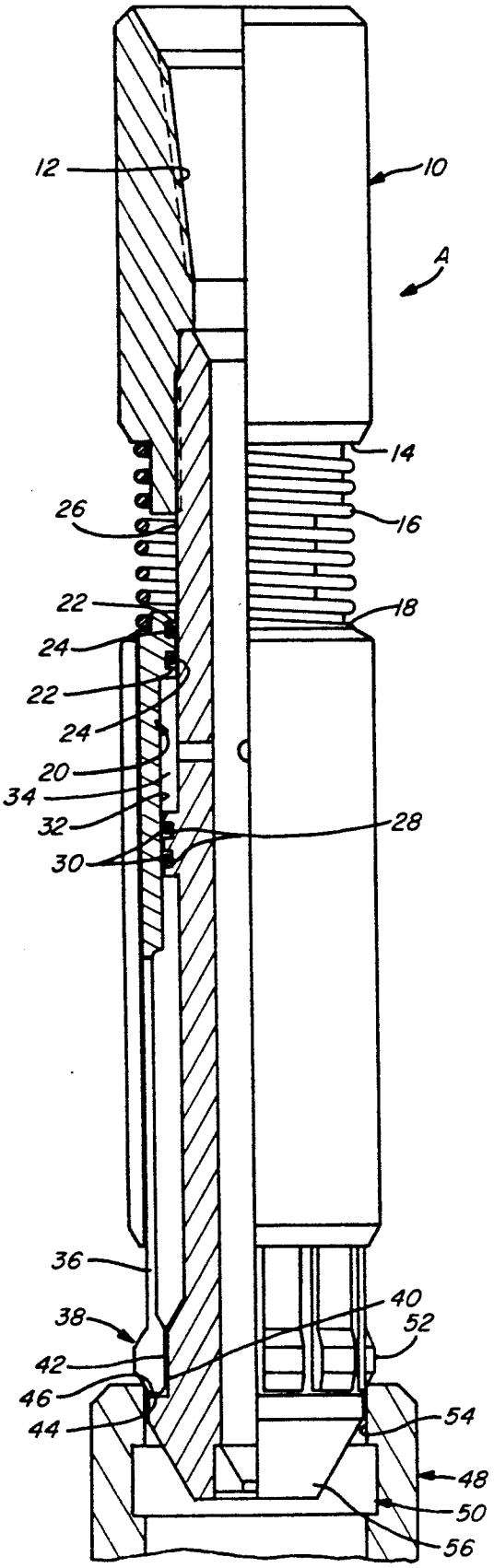
FIG. 1 is a sectional view of a spear of the present invention in the initial run-in condition.
Figure 2:
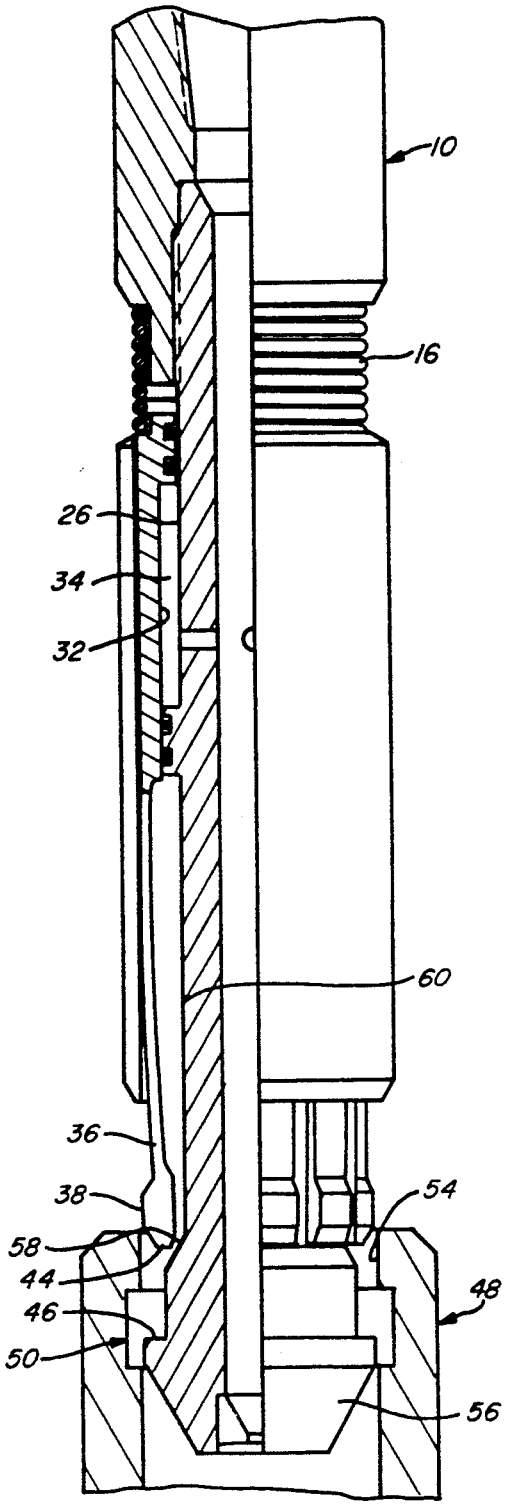
FIG. 2 is the view is the view shorted FIG. 1 in an intermediate position prior to latching on to the "fish".

Apparatus A of the present invention is illustrated in FIG. 1 in the form known as a spear. The apparatus consists of a mandrel 10 which has a thread 12 to accept a tubing string (not shown). Mandrel 10 has a shoulder 14 on which spring 16 bears at one end. The opposite end of spring 16 bears on shoulder 18 mounted to collet ring 20. Collet ring 20 is mounted for translatable movement with respect to mandrel 10 as shown in FIG. 2. Collet ring 20 has a pair of grooves 22 within which are mounted seals 24. Seals 24 seal between collet ring 20 and surface 26 on mandrel 10. Mandrel 10 further has a pair of grooves 28 within which are mounted seals 30. Seals 30 interface with surface 32 on collet ring 20. Those skilled in the art can appreciate that by virtue of the presence of seals 24 and 30 a variable volume cavity 34 is created between surfaces 32 and 26. As the spring 16 is compressed, as shown in FIG. 2, the cavity 34 increases in volume.

Collet ring 20 includes a plurality of collet fingers 36 with each collet finger 36 having a collet head 38 thereon. In the initial position, surface 40 of collet heads 38 abuts surface 42 of the mandrel 10. Additionally, surface 44 of collet heads 38 abuts surface 46 of mandrel 10. The fish 48 or otherwise known as the object to be retrieved from the well bore, is illustrated in FIG. 1. The fish 48 has an internal groove 50 machined into it expressly for the purpose of retrieval through the use of devices such as the spear A of the present invention.

Figure 3:
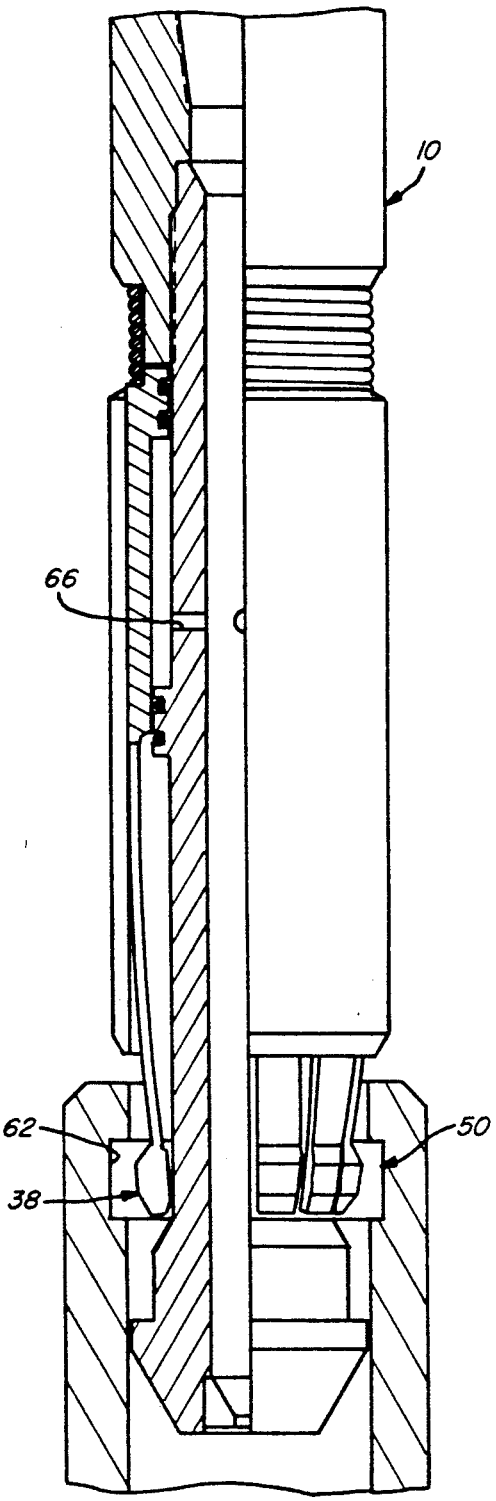
FIG. 3 is similar to FIGS. 1 and 2 but shows further movement to latching beyond FIG. 2.
Figure 4:
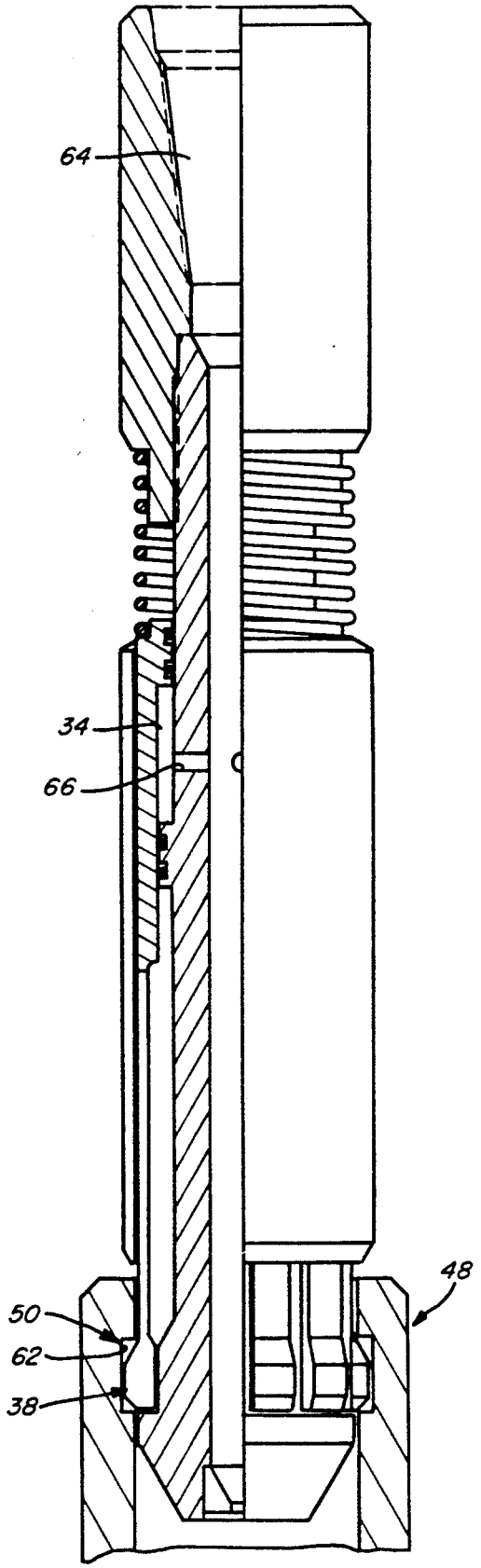
FIG. 4 shows the spear of FIG. 1 with the fish fully latched.

The outside diameter of the collet heads 38 expressed by surfaces 52 of the collet heads 38 is deliberately configured to have a larger outside diameter than opening 54 of the fish 48. As a result, when the tapered segment 56 of mandrel 10 passes through opening 54, the collet heads 38 come into contact with the body of the fish 48 as shown in FIG. 1. The exertion of a further downward force on the mandrel 10 through the tubing string (not shown) displaces tapered segment 56 further downwardly. Thus, mandrel 10 is moved with respect to collet ring 20 thus compressing spring 16. As this movement is occurring in FIG. 2, taper 58 presents itself adjacent collet heads 38. Further downward forces exerted on mandrel 10 forces collet heads 38 to deflect radially inwardly toward surface 60. Once the collet heads 38 have been deflected inwardly towards surface 60, further downward movement of the tubing string pushes the mandrel 10 to the point where collet heads 38 are in alignment with internal groove 50. (See FIG. 3) At this point in time, the collet heads 38 which are biased outwardly due to the effect of fingers 36 move outwardly toward surface 62 within groove 50. At this point in time, the spring 16 is nearly fully compressed and an upward pull on mandrel 10 brings surfaces 42 and 46 back adjacent surfaces 40 and 44, thus trapping collet heads 38 in groove 50. At this point, the fish 48 is trapped and can be raised to the surface. If during the process of removal, the fish becomes stuck again or if it cannot be unstuck with the apparatus A, it is desirable to be able to let go of the fish 48. To accomplish this, pressure is applied in the tubing (not shown) into passage 64. Passage 64 communicates with cavity 34 through port 66. By applying pressure through the tubing through passage 64 and port 66 into variable volume chamber 34 the net result is that the collet ring 20 is lifted. Those skilled in the art will appreciate that weight must first be set down on mandrel 10 prior to the application of pressure into variables volume chamber 34. The application of pressure into chamber 34 raises the collets 38 and forces them to ride up slope 58 and subsequently radially inwardly toward surface 60. By making this possible, the entire assembly can then be dislodged from fish 48 by exerting an upward pull on mandrel 10. In essence, to release from the fish 48 the same movements shown in FIGS. 2 and 3 are repeated except that the collet heads 38 are further into the fish 48 at the time of disengagement.

Figure 5:
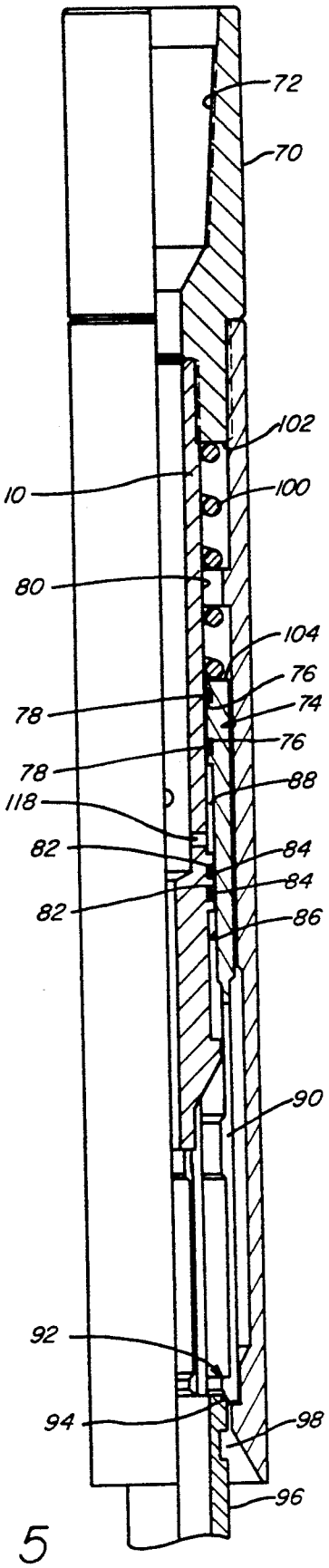
FIG. 5 shows an overshot of the present invention in the run-in position.
Figure 7:
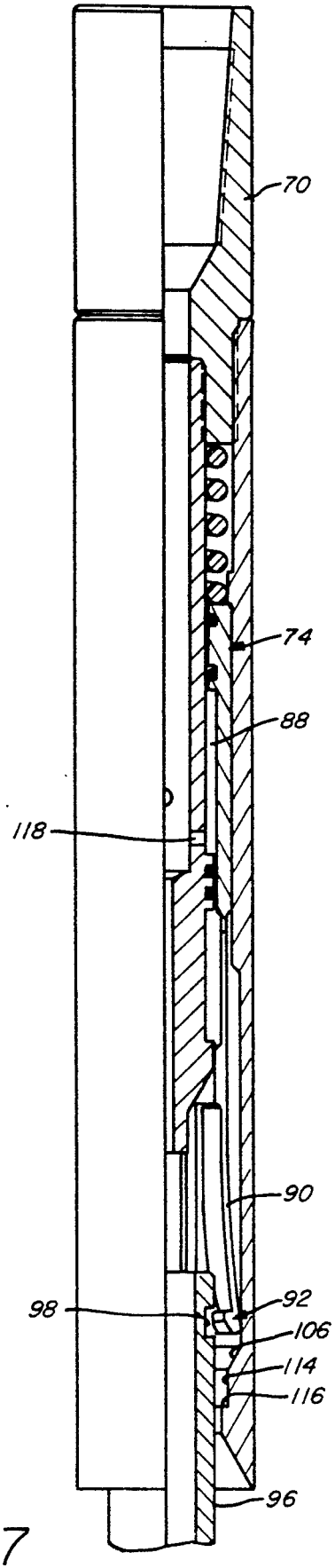
FIG. 7 is the tool of FIG. 6 with further movement of latching on to the fish.

Referring now to FIG. 7, the apparatus A in the overshot embodiment is illustrated. The sequence of operation, however, is similar to the spear illustrated in FIGS. 1-4. FIG. 5 shows a mandrel 70 having a thread 72. Circumscribing a portion of mandrel 70 is collet ring 74. Collet ring 74 has a pair of grooves 76 within which are located seals 78. Seals 78 ride on surface 80 of mandrel 10. Mandrel 10 has a pair of grooves 82 within which are located seals 84. Seals 84 ride on surface 86 of collet ring 74. Seals 78 and 84 seal off a variable volume cavity 88 whose functions will be described below.

Collet ring 74 has a plurality of collet fingers 90, each of which terminate in a collet head 92. Collet heads 92 have a tapered surface 94. The diameter inside taper 94 is deliberately made smaller than the outside diameter of the fish or object to be retrieved 96. Fish 96 has an external groove 98 located adjacent its upper end. Spring 100 bears on shoulder 102 of mandrel 70. The other end of spring 100 bears on surface 104 of collet ring 74.

Figure 6:
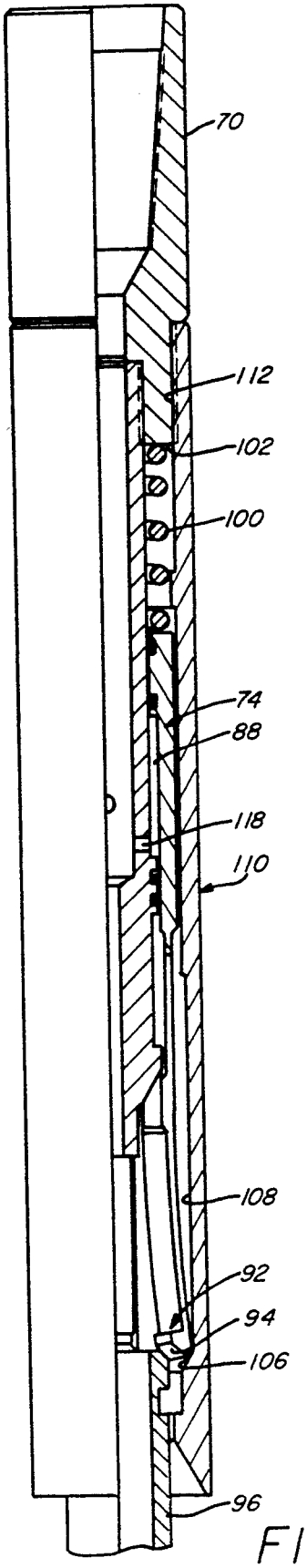
FIG. 6 shows the overshot of FIG. 5 with movement towards latching onto the fish.

Referring now to FIG. 6, it can be seen that because the diameter inscribed within taper 94 is smaller than the outside diameter of fish 96, applying weight to the tubing string (not shown) in turn puts a downward force on mandrel 70. Once downward forces are exerted on mandrel 70, it moves with respect to collet ring 74 as shown in FIG. 6. The collet heads 92 are pushed back along tapered surface 106 as further downward force is applied to mandrel 70. As the collet heads 92 come up even with tapered surface 106, they are deflectable outwardly toward surface 108 of cover 110. Cover 110 is attached to mandrel 70 at thread 112. When the collet heads 92 are deflected outwardly and upwardly, as shown in FIG. 6, spring 100 is compressed against shoulder 102. Cavity 88 grows in volume.

Figure 8:
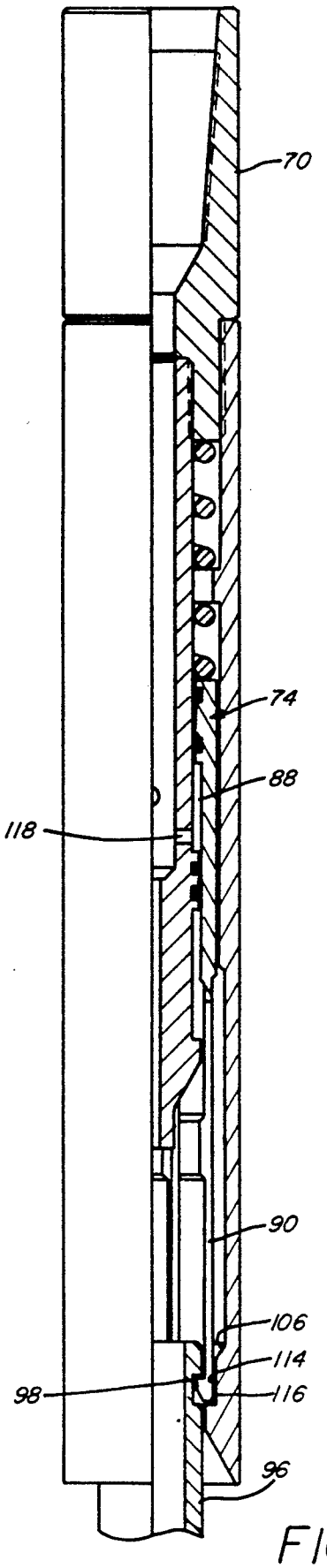
FIG. 8 is the overshot of FIG. 5 with the fish fully latched.

Referring to FIG. 7, it is seen that the fish 96 has moved further upwardly so that groove 98 now is juxtaposed against the collet heads 92. At the point shown in FIG. 7, the collet heads 92 have been radially outwardly displaced and have a bias due to the flexing of collet fingers 90. With the groove 98 aligned opposite collet heads 92, the collet heads 92 spring back radially inwardly into the groove 98, as shown in FIG. 8. Thereafter, picking up on mandrel 70 wedges the collet heads 92 against surfaces 114 and 116. When the collet heads 92 are wedged against shoulder 116 and surface 114 and in groove 98, the fish 96 is secured to the mandrel 70.

Thereafter, should it be desired to release the fish 96 for any reason, fluid pressure is applied in the tubing string (not shown). The pressure in the tubing string is communicated into passage 118, which is in fluid communication with chamber 88. Due to the increase of pressure applied to chamber 88, the collet ring 74 is upwardly displaced. It should be noted that prior to applying pressure to chamber 88, the weight of the tubing string (not shown) is let down on mandrel 70. As a result of the increase in fluid pressure to chamber 88, the collet ring moves upwardly, taking up with it fish 96 until the collet heads 92 rise to the level of tapered surface 106. After that point, further upward movement of collet ring 74 dislodges the collet heads 92 from groove 98. Thereafter, with pressure still retained in chamber 88, an upward force is applied to the tubing string (not shown) and, as a result, there is disengagement from the fish 96.

Figure 9:
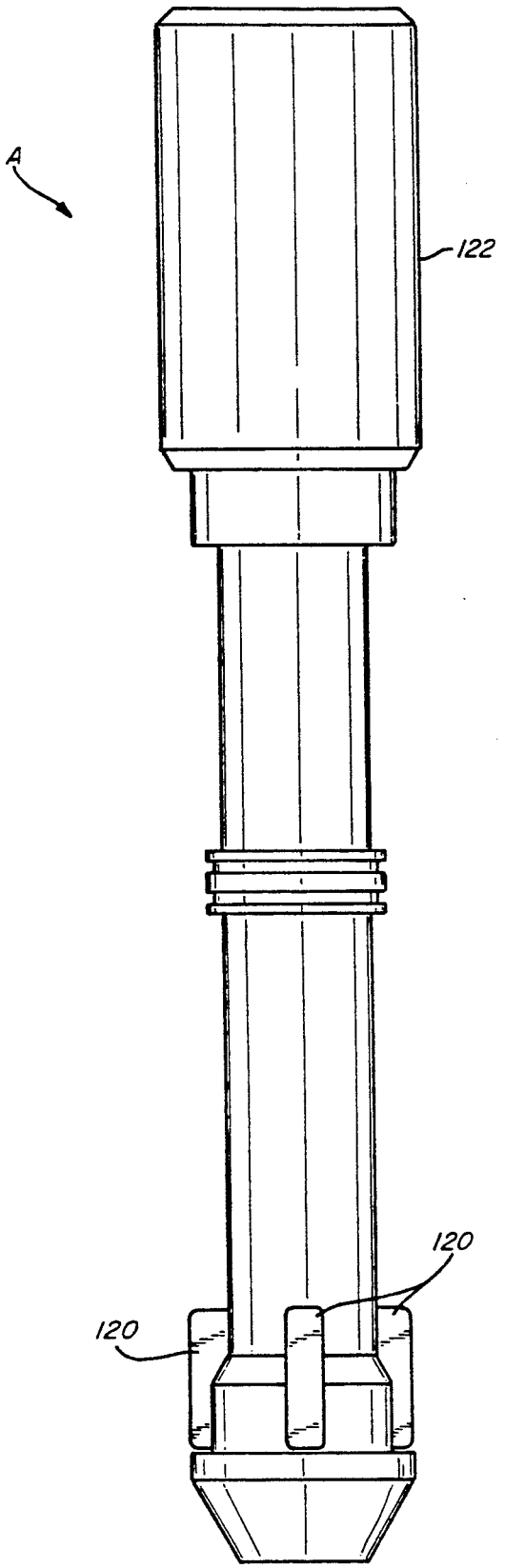
FIG. 9 is an alternative embodiment of the spear of FIG. 1 showing lugs to promote transmission of torsional forces.
Figure 10:
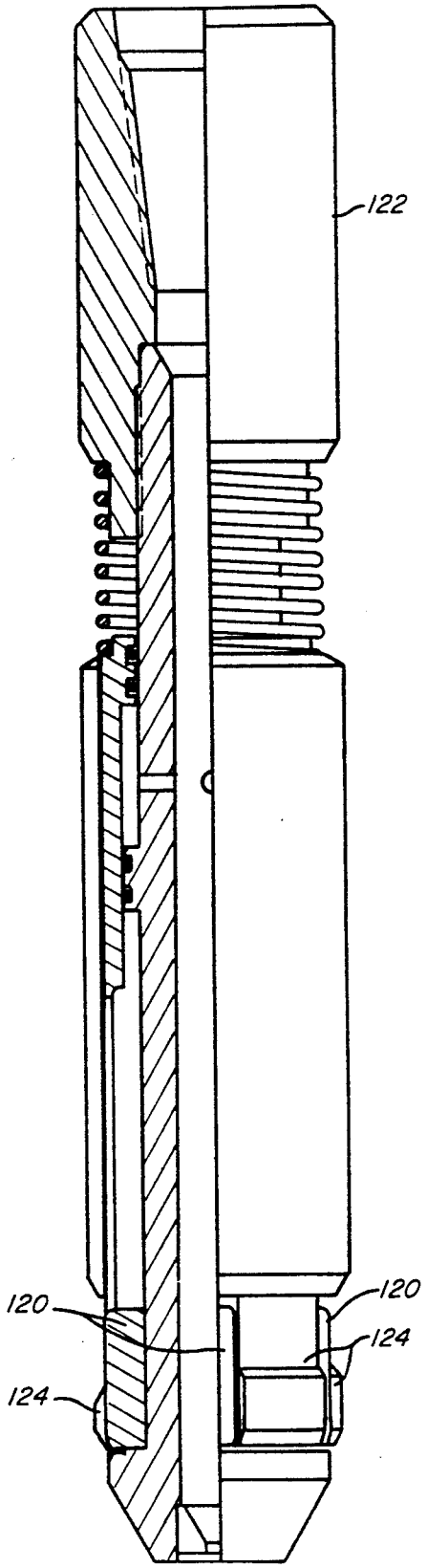
FIG. 10 is similar to FIG. 9 but shows a cut-away view of the tool with lugs to promote transmission of torsional forces.

Referring now to FIGS. 9 and 10, the version of the apparatus A which is known as a spear is illustrated in a modified form. This modification is also applicable to the overshot shown in FIGS. 5-8. The apparatus shown in FIGS. 9 and 10 is in all ways similar to the apparatus shown in FIG. 1 except for the presence of lugs 120. Lugs 120 are directly connected to mandrel 122 and are interspaced between collet heads 124. In the embodiment shown in FIGS. 9 and 10, there are fewer collet fingers than in the embodiment shown in FIG. 1. An alternating pattern of collet heads 124 and lugs 120 is presented as shown in FIG. 10. The advantage of having the lugs is that when the fish is engaged via collet heads 124, a torsional force can be applied to the fish to loosen it from a stuck position. In the past, designs have not permitted the application of any significant amount of torque. One of the reasons has been because prior designs of spears or overshots have employed shear pins to allow them to disengage. The application of a significant amount of torque on prior designs put the shear pin in danger of failure, thus releasing the fish. The present design as shown in FIGS. 9 and 10 puts the lugs 120 in between collet 124. This gives additional torsional rigidity to the collets 124 and allows an application of a torsional force to the mandrel 122. The torsional force is then transmitted through mandrel 122 into collet heads 124, which are in turn forcibly in contact with a groove on the fish specifically designed for engagement with such collet heads 124. As to the embodiment shown in FIGS. 5–7, the trapping of the collet heads 92 up against surfaces 114 and 116 when the fish is engaged also gives structural support to the collet heads 92. This facilitates the ability to impart torsional forces to the fish through a rotational force applied to mandrel 70. Similarly, in the embodiment shown in FIGS. 1–4, the trapping of the collet heads 38 up against surfaces 42 and 46 further makes it possible to impart torsional forces through the collet heads 38 without shearing them off at their connection to collet fingers 36. In essence, surfaces 42 and 46 back up or support the collet heads 38 when they are engaged in groove 50 of the fish 48 to facilitate the transmission of torsional forces.

Those skilled in the art will appreciate that the release mechanism of the spear and overshot of the present invention is a marked improvement over current designs using shear pins to effectuate release. The problem with the prior shear pin designs is that it limited the amount of pulling and/or torsional force that could be applied to prior tools. Furthermore, it created an uncertainty as to the performance of prior tools because, due to cycles of operation, the force at which shear pins in prior designs would shear could differ. As a result, for precautionary measures it would have been prudent in past designs to replace the shear pins prior to each use. This is, of course, needlessly troublesome and costly. The apparatus A of the present invention, by releasing with a fluid force, gives predictable operation regardless of how many cycles. It also offers the additional advantage of being able to release the fish and grab back onto it without having to bring the apparatus out of the wellbore. In past designs that operated on a shear-pin principle, any kind of intentional or accidental shearing of the pin would require that the tool be brought out of the wellbore prior to its reuse. This tool does not have that disadvantage. Additionally, the design configuration illustrated and described, including but not limited to the use of the lugs 120, presents a marked improvement over spears and overshots of the prior art in that the ability to reliably apply a torsional force without worrying about accidental shearing of pins or permanent deformation of the body of the tool has now been accomplished.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for retrieving an object from a wellbore, comprising:

a body;

gripping means on said body for selectively gripping the object, said gripping means initially displaced by the object in a direction opposite movement of said body to facilitate engagement of the object by said gripping means; and fluid-actuated release means on said body to selectively overcome said gripping means to release the object.

2. An apparatus for retrieving an object from a wellbore, comprising:

a body;

gripping means on said body for selectively gripping the object, said gripping means initially displaced by the object to facilitate engagement of the object by said gripping means; and fluid-actuated release means on said body to selectively overcome said gripping means to release the object;

said gripping means comprises a gripping member slidably mounted with respect to said body;

said gripping member defining a sealed cavity with said body whose volume varies with movement of said gripping member;

means for applying fluid pressure to said cavity to create relative movement between said body and said gripping member.

3. The apparatus of claim 2, further comprising:

biasing means on said body bearing on said gripping member to push it toward a position where said cavity is at its smallest volume, whereupon selective application of fluid pressure into said cavity increases its volume by moving said gripping member against the biasing force of said biasing means.

4. An apparatus for retrieving an object from a wellbore, comprising:

a body;

gripping means on said body for selectively gripping the object;

fluid-actuated release means on said body to selectively overcome said gripping means to release the object;

said gripping means further comprises:

a gripping member slidably mounted with respect to said body;

said gripping member defining a sealed cavity with said body whose volume varies with movement of said gripping member;

means for applying fluid pressure to said cavity to create relative movement between said body and said gripping member;

biasing means on said body bearing on said gripping member to push it toward a position where said cavity is at its smallest volume, whereupon selective application of fluid pressure into said cavity increases its volume by moving said gripping member against the biasing force of said biasing means;

said gripping member comprises a collet member comprising at least one collet extending therefrom;

said body further comprising a tapered surface;

said collet selectively displaced along said tapered surface by the object to be retrieved, upon relative movement between the object and said body, said displacement allowing relative motion between the collet and the object initiated by said biasing means to facilitate gripping the object by said collet; and said fluid pressure application means overcoming said biasing means to move said collet toward said tapered surface for displacement of said collet therealong to release the object.

5. The apparatus of claim 4, wherein:

said biasing means comprising a spring biasing said collet member to selectively push said collet away from said tapered surface toward a position where said collet can selectively securely engage the object;

whereupon application of fluid pressure to said cavity, said biasing means are overcome and said collet is moved toward said tapered surface where it can move radially away from the object to disengage the object.

6. The apparatus of claim 5, wherein:

said body has a radial surface adjacent said tapered surface and a shoulder adjacent said radial surface;

said collet selectively grabs the object by wedging between said shoulder, said radial surface, and the object.

7. The apparatus of claim 6, further comprising:

stiffener means mounted to said body adjacent said collet for increasing the ability to transmit rotational force from said body to the object through said collet.

8. The apparatus of claim 7, further comprising:

a plurality of collets, said stiffener means comprising a plurality of lugs disposed between at least some of said collets to stiffen said collets for transmission of torsional forces.

9. The apparatus of claim 1, further comprising:

stiffener means on said body in contact with said gripping means to increase the ability to transmit rotational forces to the object.

10. The apparatus of claim 9, wherein:

said gripping means further comprises:

a gripping member slidably mounted with respect to said body;

said gripping member defining a sealed cavity whose volume varies with movement of said gripping member;

means for applying fluid pressure to said cavity to create relative movement between said body and said gripping member.

11. The apparatus of claim 10, further comprising:

biasing means on said body bearing on said gripping member to push it toward a position where said cavity is at its smallest volume, whereupon selective application of fluid pressure into said cavity increases its volume by moving said gripping member against the biasing force of said biasing means.

12. The apparatus of claim 11, wherein:

said gripping member comprises a collet member comprising at least one collet extending therefrom;

said body further comprising a tapered surface;

said collet selectively displaced along said tapered surface by the object to be retrieved, upon relative movement between the object and said body, said displacement allowing relative motion between the collet and the object initiated by said biasing means to facilitate gripping the object by said collet; and said fluid pressure application means overcoming said biasing means to move said collet toward said tapered surface for displacement of said collet therealong to release the object.

13. The apparatus of claim 12, further comprising:

a plurality of collets, said stiffener means comprising a plurality of lugs disposed between at least some of said collets to stiffen said collets for transmission of torsional forces.

14. The apparatus of claim 13, wherein:

said biasing means comprising a spring biasing said collet member to selectively push said collet away from said tapered surface toward a position where said collet can selectively securely engage the object;

whereupon application of fluid pressure to said cavity, said biasing means are overcome and said collet is moved toward said tapered surface where it can move radially away from the object to disengage the object.

15. The application of claim 14, wherein:

said body has a radial surface adjacent said tapered surface and a shoulder adjacent said radial surface;

said collet selectively grabs the object by wedging between said shoulder, said radial surface, and the object.

16. A method of gripping and selectively releasing an object in a wellbore, comprising:

lowering a tool to the object;

displacing at least one collet on said tool by further lowering the tool;

using the object to displace said collet;

gripping the object with the collet;

securing said gripping by forcing the collet against the object;

applying fluid pressure to a cavity between the body and a ring member, slidably mounted to the body, and connected to the collet;

moving the ring member and the collet attached to it due to said fluid pressure;

freeing the collet to move away from the object to release it.

17. The method of claim 16, further comprising the steps of:

supporting the collet against torsional force;

applying a torsional force to the tool;

transmitting the torsional force to the object through said supported collet.

18. The method of claim 17, further comprising the step of:

biasing said ring member to push said collet to a position where its radial movement is fixed;

overcoming said biasing by displacing said collet toward a tapered surface with the object;

allowing said collet to move away from the object;

allowing relative movement between the object and the collet due to said biasing force;

forcing the collet into secured engagement with the object with said biasing force.

* * * * *